US007610703B2

(12) United States Patent
Thum

(10) Patent No.: US 7,610,703 B2
(45) Date of Patent: Nov. 3, 2009

(54) SERVING DISH FOR CHILDREN

(76) Inventor: Elisabeth Thum, Erdbergstrasse 138, Vienna A-1030 (AT)

( * ) Notice: Subject to any disclaimer, the term of this patent is extended or adjusted under 35 U.S.C. 154(b) by 73 days.

(21) Appl. No.: 11/941,164

(22) Filed: Nov. 16, 2007

(65) Prior Publication Data

US 2008/0060963 A1 Mar. 13, 2008

Related U.S. Application Data

(60) Division of application No. 11/052,685, filed on Feb. 7, 2005, now Pat. No. 7,437,841, which is a continuation-in-part of application No. PCT/AT2003/000226, filed on Aug. 5, 2003.

(30) Foreign Application Priority Data

Aug. 6, 2002 (AT) ..... GM 525/2002

(51) Int. Cl.
*G09F 11/04* (2006.01)

(52) U.S. Cl. ..... 40/324; 40/488; 40/490; 40/491

(58) Field of Classification Search ..... 40/324, 40/490, 491, 488; 220/574, 575
See application file for complete search history.

(56) References Cited

U.S. PATENT DOCUMENTS

| | | | | |
|---|---|---|---|---|
| 357,689 | A | | 2/1887 | Porrera |
| 657,834 | A | | 9/1900 | Jameson |
| 683,888 | A | | 10/1901 | Bright |
| 697,907 | A | | 4/1902 | Wilder |
| 783,401 | A | | 2/1905 | Curran |
| 1,232,120 | A | | 7/1917 | Sutter |
| 1,992,028 | A | | 2/1935 | Harper |
| 2,156,351 | A | | 5/1939 | Paul |
| 2,485,922 | A | | 10/1949 | Rubin |
| 2,514,094 | A | | 7/1950 | Rubin |
| 2,542,400 | A | | 2/1951 | Donofrio |
| 2,781,650 | A | * | 2/1957 | Lee ..... 40/324 |
| 2,861,367 | A | | 11/1958 | Chanslor |
| 2,871,650 | A | | 2/1959 | Kooistra |
| 3,262,640 | A | | 7/1966 | Jameson |
| 6,158,155 | A | | 12/2000 | Boney |

FOREIGN PATENT DOCUMENTS

| | | |
|---|---|---|
| FR | 1030091 A | 6/1953 |
| GB | 2332897 A | 7/1999 |

* cited by examiner

*Primary Examiner*—Cassandra Davis
(74) *Attorney, Agent, or Firm*—Laurence A. Greenberg; Werner H. Stemer; Ralph E. Locher

(57) ABSTRACT

A serving dish for small children has a window through which exchangeable pictures can be viewed. The dish has an upper dish with a transparent window, a lower dish, and an exchangeable picture carrier situated in between. In order to permit easy cleaning of the dish and simple replacement of the pictures, the upper dish is fastened to the lower dish with at least one central fastening element bearing at least one rotatable picture carrier, such that different pictures are displayed in the window when the picture carrier is rotated.

6 Claims, 5 Drawing Sheets

SERVING DISH FOR CHILDREN

CROSS-REFERENCE TO RELATED APPLICATIONS

This is a division of U.S. application Ser. No. 11/052,685, filed Feb. 7, 2005, which was a continuation-in-part application, under 35 U.S.C. § 120, of international application No. PCT/AT2003/000226, filed Aug. 5, 2003, which designated the United States; this application also claims the priority, under 35 U.S.C. § 119, of Austrian application GM 525/2002, filed Aug. 6, 2002; the prior applications are herewith incorporated by reference in their entirety.

BACKGROUND OF THE INVENTION

Field of the Invention

The invention relates to a serving dish for small children featuring exchangeable pictures, which comprises an upper dish with a transparent window and a lower dish and an exchangeable picture carrier situated in between.

Pictures or motifs on food bowls are a known feature intended to stimulate a child's appetite and motivation to eat. In many of these dishes the picture on the surface of the bowl will soon wear off or be destroyed by the child's manipulations or cutlery.

U.S. Pat. No. 2,861,367 to Chanslor describes a serving dish for children which is configured as a plastic bowl with a window in the bottom area. Its outer periphery is provided with three supporting legs, each exhibiting a slot on the inner face at half height. In the slots of the three legs a circular picture carrier or disk is guided, which is supported on a central pin on the underside of the bottom of the plastic bowl. The picture disk contains a series of pictures which can be viewed through the transparent window in the plastic bowl.

U.S. Pat. No. 2,514,094 to Rubin discloses a child's serving dish where a bowl to be filled with water is provided as a lower part, which by means of lateral recesses on its inner rim can be firmly connected with an upper part exhibiting corresponding projections on its outer rim. The upper part has a central opening via which the lower part may be filled with water to keep the meals warm. A tubular rotary element penetrates through the central opening of the upper part, with a picture carrier fastened to its bottom end. The top end of the tubular rotary element is plugged with a stopper, which is provided with a turning knob projecting above the surface of the dish. By means of this turning knob the picture carrier can be moved and the individual pictures will appear in the windows on the bottom of the upper part.

The food bowls for children described above have a relatively complicated design and cannot easily be taken apart for cleaning purposes or for exchanging the picture carrier.

BRIEF SUMMARY OF THE INVENTION

It is accordingly an object of the invention to provide a child's serving dish, which overcomes the above-mentioned disadvantages of the heretofore-known devices and methods of this general type and which is a simplified version thereof, and where the dish is easy to clean and the picture carrier is easy to replace.

With the foregoing and other objects in view there is provided, in accordance with the invention, a serving dish for small children, comprising:

an upper dish formed with a transparent window;

a lower dish;

at least one exchangeable, rotatable picture carrier with pictures between the upper dish and the lower dish; and at least one central fastening element fastening the upper dish to the lower dish, the fastening element bearing the rotatable picture carrier such that different pictures are displayed in the transparent window when the picture carrier is rotated.

In other words, the objects of the invention are achieved by fastening the upper dish to the lower dish with at least one central fastening element, which fastening element bears at least one rotatable picture carrier such that different pictures are displayed in the window when the picture carrier is rotated. It is especially provided that the central fastening element is configured as an axle pin held in the lower dish.

In the present invention the upper dish can be detached with only little effort by withdrawing the axle pin from the corresponding opening in the lower dish. The upper dish can thus be washed easily. Moreover, the exposed picture carrier can be removed and replaced by another one with a different series of pictures. According to the invention at least one recess may be provided along the circumference of the upper dish for turning the at least one picture carrier.

With the above and other objects in view there is also provided, in accordance with the invention, a serving dish for small children, comprising:

a lower dish formed with a groove;

an upper dish formed with a transparent window, the upper dish having a lower side formed with a rim engaging the groove in the lower dish;

at least one exchangeable picture carrier between the upper dish and the lower dish; and the lower dish having a recess formed therein, the recess being configured to enable the picture carrier to be moved across the transparent window in the upper dish for displaying different pictures in the transparent window.

In the second embodiment the upper dish has a rim on its lower side, which engages a groove of the lower dish, and the lower dish has a further recess through which a picture carrier can be moved across the window in the upper dish so that diverse pictures will appear in the window. The picture carriers can be exchanged easily and quickly and be provided with different pictures or words and poems, depending on the child's age In accordance with an added feature of the invention, the lower dish is formed with a central opening and the central fastening element is an axle pin held within the central opening in the lower dish.

In accordance with an additional feature of the invention, the central fastening element is an integral part of the upper dish.

In accordance with an another feature of the invention, the upper dish and the lower dish are provided with adjacent second fastening elements disposed concentrically about the central fastening element.

In accordance with a further feature of the invention, the upper dish has a periphery formed with at least one recess for enabling access to the at least one picture carrier.

In accordance with an added feature of the invention, the picture carrier is one of two independently rotatable picture carriers (first embodiment) or one of two independently translatable such carriers (second embodiment) having pictures complementing one another in the transparent window.

In accordance with an added feature of the invention, the transparent window carries partial pictures configured to complement other partial pictures on the picture carrier to form a complete picture.

In accordance with an added feature of the invention, the lower dish is configured with a non-slip support.

In accordance with an added feature of the invention, the lower dish has a bottom formed with fastening means, such as one or more suction cups.

Other features which are considered as characteristic for the invention are set forth in the appended claims.

Although the invention is illustrated and described herein as embodied in a Serving Dish for Children, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
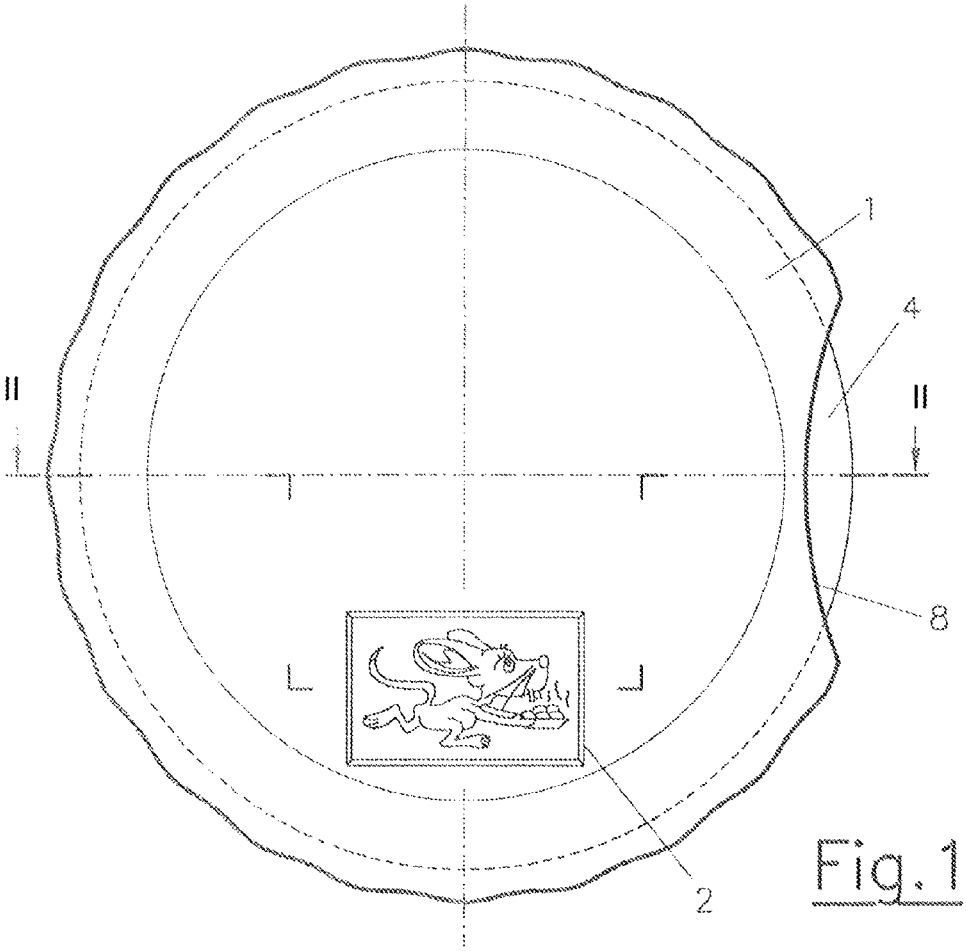
FIG. 1 is a plan view of a first embodiment of the serving dish according to the invention.

Referring now to the figures of the drawing in detail and first, particularly, to FIGS. 1 to 3 and 8 thereof, there is shown a first embodiment of a serving dish according to the invention. An upper dish 1 is attached to a lower dish 3 by way of a central fastening element. Here, the fastening element is an axle pin 7. Beneath the upper dish 1 there is an exchangeable picture carrier 4 held by the axle pin 7. The terms "picture carrier" and "pictures" should be understood in their broadest sense, as including any suitable optical and visual stimulus. As such, various pictures, comics, lines of text, or stories may be printed on the picture carrier 4. A recess 8 or indentation on the periphery of the upper dish 1 permits the turning of the picture carrier 4. The pictures 5 may be viewed through a transparent window 2 in the upper dish 1. In its main intent, the pictures or other content on the picture carrier 4 thus viewed will stimulate the child to eat. It is also possible to provide two independently turnable picture carriers whose pictures 5 complement each other in the transparent window 2.

It is furthermore possible to attach parts of the pictures firmly to the underside of the transparent window 2, which will be complemented by other parts of pictures on the movable picture carrier 4 to form a complete picture 5. The pictures could for instance by resolved into pixels with part of the pixels on the transparent window and the other part on the movable picture carrier 4, such that the whole picture will only be recognized when the parts overlap.

Figure 2:
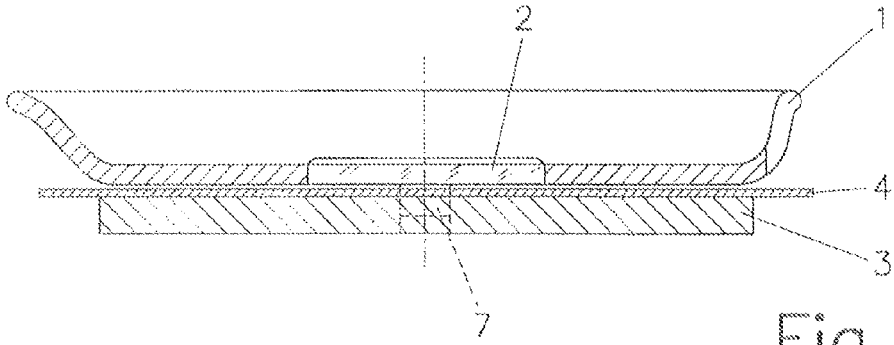
FIG. 2 is a side view of a section taken along the line II-II shown in FIG. 1.
Figure 3:
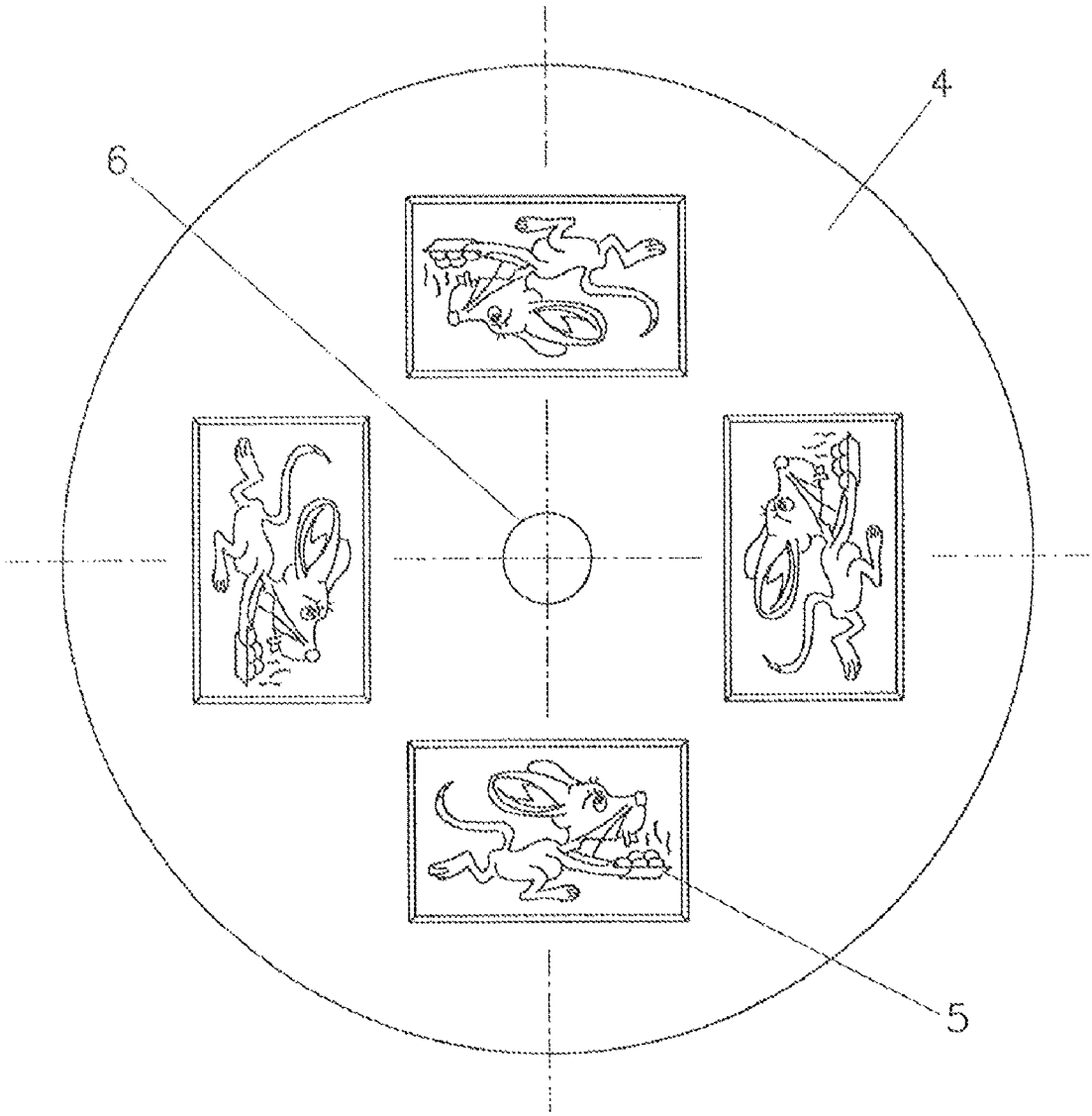
FIG. 3 is a plan view of the picture carrier suitable for the first embodiment of FIG. 1.

FIG. 2 shows the child's serving dish according to the invention in a section along line II-II of FIG. 1. The upper dish 1 is held in the lower dish by means of the axle pin 7. The picture carrier 4 is situated between the dishes. FIG. 3 shows the exchangeable picture carrier 4 with pictures 5 and an axle opening 6 through which the pin 7 penetrates.

Figure 4:
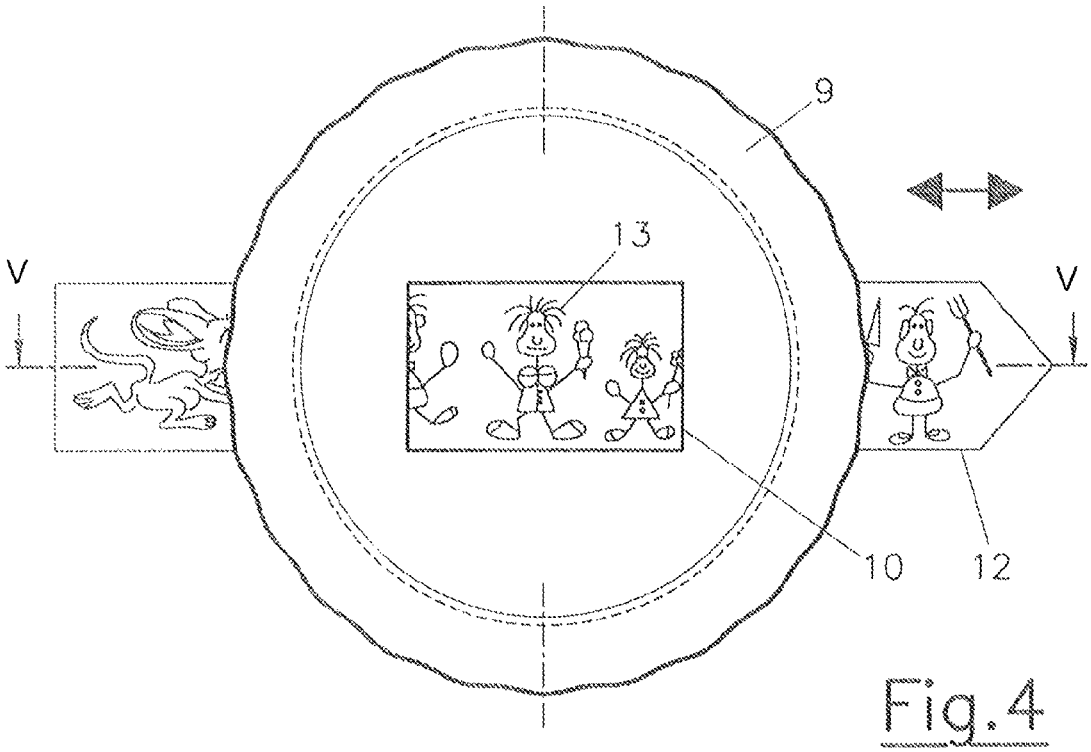
FIG. 4 is a plan view of a second embodiment of the serving dish according to the invention.
Figure 5:
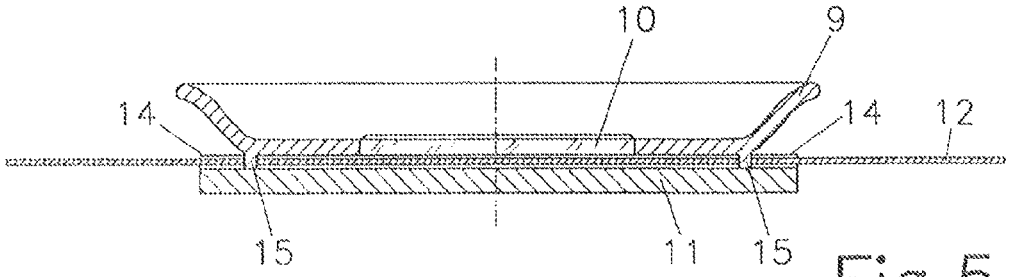
FIG. 5 is a side view of a section taken along the line V-V shown in FIG. 4.
Figure 7:
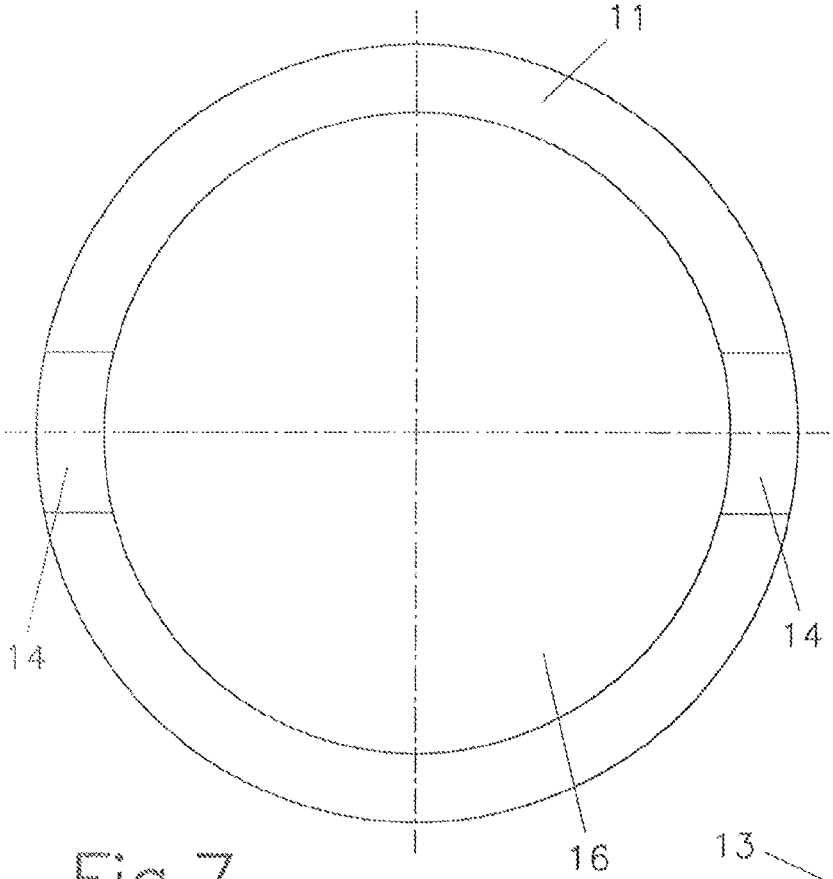
FIG. 7 is a plan view of the lower dish of the second embodiment of the invention.
Figure 6:
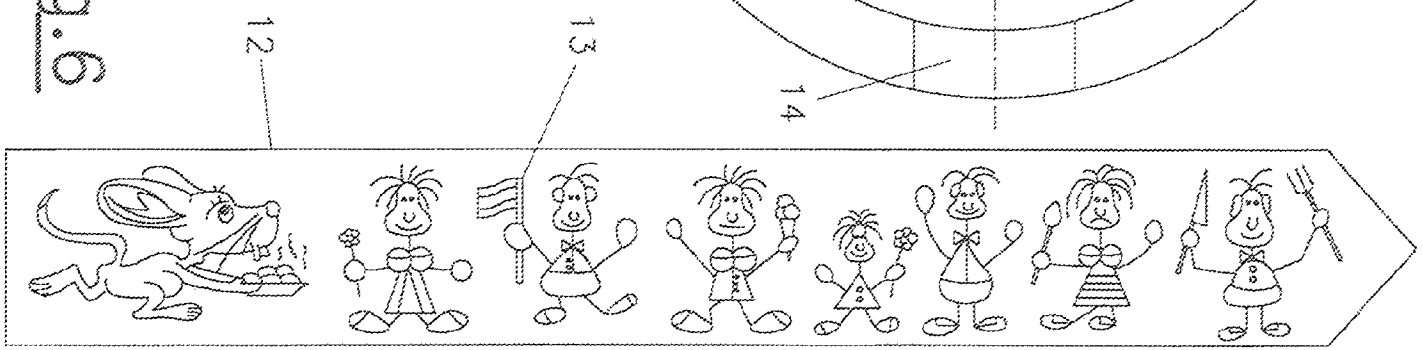
FIG. 6 is a plan view showing the picture carrier of the second embodiment in the form of a picture strip.

FIG. 4 to 7 present the second embodiment of the serving dish according to the invention, with FIG. 4 showing the transparent window 10 through which the picture carrier 12 with its various pictures 13 can be seen. FIG. 5 shows the serving dish in a section along line V-V. The upper dish 9 has at least one transparent window 10 and locks into a groove 16 of the lower dish 11 by means of a rim 15 on its bottom. The lower dish 11 is provided with a recess 14 (FIG. 7) which guides the picture carrier 12 configured as a strip. The child may draw the picture carrier through the recess 14 whereby various motifs, comics or stories are presented in the transparent window—as in the first embodiment of the invention. FIG. 6 shows the picture carrier 12 with different pictures 13.

In the second embodiment the pictures may also be resolved into pixels, with part of the pixels attached to the transparent window 10 and the other part to the movable picture carrier 12, such that a readable text or a recognizable motif will only appear when the two parts overlap.

Figure 8:
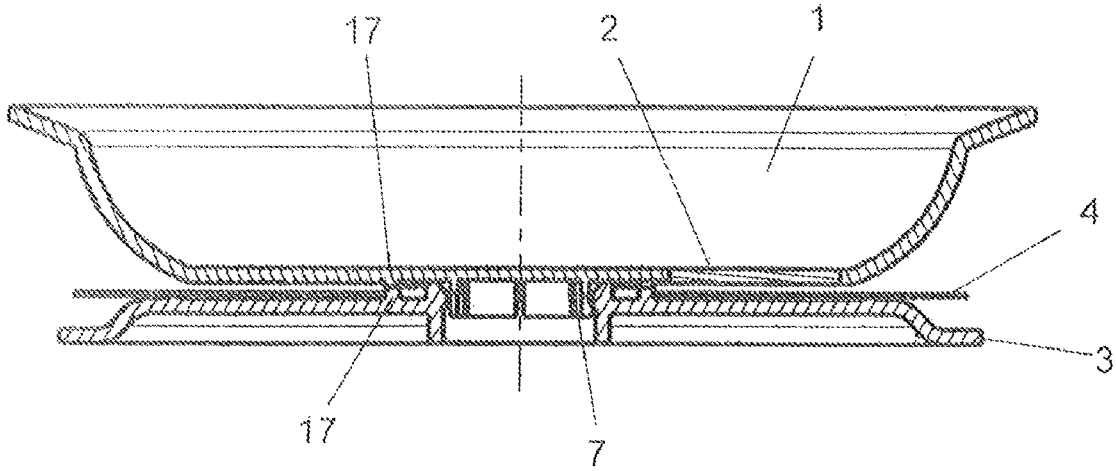
FIG. 8 is a side view of a section through an alternative of the embodiment of FIG. 2.

FIG. 8 illustrates a variation of the embodiment of the serving dish illustrated in FIG. 2. The central fastening element 7 is configured as a tubular axle pin that is held within a central opening formed in the lower dish 3. The central fastening element 7 is an integral part of the upper dish 1. Further, the upper dish 1 and the lower dish 3 are provided with mutually adjacent second fastening elements 17, e.g., engaged interlocking means, disposed concentrically to the central fastening element 7, to establish a torque proof connection between the upper dish 1 and the lower dish 3.

In both embodiments the lower dish 3 may be configured so as to be non-slipping or the bottom may be provided with a fastening means such as a suction cup.

The invention claimed is:

1. A serving dish for children, comprising:

a lower dish formed with a groove;

an upper dish formed with a transparent window and sidewalls forming a bowl, said upper dish having a lower side formed with a rim engaging said groove in said lower dish;

at least one exchangeable picture carrier between said upper dish and said lower dish;

said lower dish having a recess formed therein, said recess being configured to enable said picture carrier to be moved across said transparent window in said upper dish for displaying different pictures in said transparent window; and said transparent window carrying partial pictures confiqured to complement other partial pictures on said movable picture carrier to form a complete picture.

2. The serving dish according to claim 1, wherein said picture carrier is one of two independently movable picture carriers having pictures complementing one another in said transparent window.

3. The serving dish according to claim 1, wherein said lower dish is configured with a non-slip support.

4. The serving dish according to claim 3, wherein said lower dish has a bottom formed with fastening means.

5. The serving dish according to claim 4, wherein said fastening means is a suction cup.

6. A serving dish for children, comprising:

a lower dish formed with a groove;

an upper dish formed with a transparent window and sidewalls forming a bowl, said upper dish having a lower side formed with a rim engaging said groove in said lower dish;

two independently movable, exchangeable picture carriers between said upper dish and said lower dish;

said lower dish having a recess formed therein, said recess being configured to enable said picture carriers to be moved across said transparent window in said upper dish for displaying different pictures in said transparent window; and wherein said picture carriers carry partial pictures complementing one another to form a complete picture in said transparent window.

* * * * *